US005577602A

United States Patent [19]

Conner et al.

[11] Patent Number: 5,577,602

[45] Date of Patent: Nov. 26, 1996

[54] SWITCH EXTENDER APPARATUS

[75] Inventors: Glenn C. Conner, 7501 Saginaw Way, Citrus Heights, Calif. 95610; Martin J. Rapozo, 541 Pico Way, Sacramento, Calif. 95819; Scott M. Perry, Auburn, Calif.

[73] Assignees: Glenn C. Conner, Citrus Heights; Martin J. Rapozo, Sacramento, both of Calif.

[21] Appl. No.: 548,079

[22] Filed: Oct. 25, 1995

[51] Int. Cl.[6] ..... H01H 3/02

[52] U.S. Cl. ..... 200/331; 174/66; 200/330

[58] Field of Search ..... 200/330, 331, 200/547; 174/66

[56] References Cited

U.S. PATENT DOCUMENTS

| | | | |
|---|---|---|---|
| 1,772,982 | 8/1930 | Brachtl | 200/330 |
| 2,668,456 | 2/1954 | Meistrell . | |
| 3,004,128 | 10/1961 | Mikolajeski . | |
| 3,188,439 | 6/1965 | Fullerton | 200/331 |
| 3,816,686 | 6/1974 | Budd et al. . | |
| 3,825,710 | 7/1974 | Roberts et al. . | |
| 3,839,615 | 10/1974 | Bradford | 200/331 |
| 3,892,935 | 7/1975 | Patterson . | |
| 3,916,134 | 10/1975 | Hansen | 200/331 |
| 3,946,186 | 3/1976 | Howie, Jr. . | |
| 4,295,026 | 10/1981 | Williams et al. . | |
| 4,454,401 | 6/1984 | Powis, Jr. . | |
| 4,548,132 | 10/1985 | Moon . | |
| 4,562,325 | 12/1985 | De Rouen . | |
| 4,590,345 | 5/1986 | Marshell . | |
| 4,705,924 | 11/1987 | Hevoyan . | |
| 4,760,227 | 7/1988 | Boxer . | |
| 4,800,239 | 1/1989 | Hill . | |
| 4,870,232 | 9/1989 | Hoogland | 200/331 |
| 4,914,265 | 4/1990 | Mongeau . | |
| 4,973,801 | 11/1990 | Frick et al. . | |
| 5,055,645 | 10/1991 | Hull et al. . | |
| 5,099,087 | 3/1992 | Barrell . | |
| 5,380,967 | 1/1995 | Steen et al. | 200/331 |
| 5,393,946 | 2/1995 | De La Hoz | 200/331 |
| 5,422,453 | 6/1995 | Smith et al. | 200/331 X |
| 5,448,031 | 9/1995 | Concannon et al. | 200/331 |

FOREIGN PATENT DOCUMENTS

| | | | |
|---|---|---|---|
| 1242236 | 9/1988 | Canada . | |
| 860345 | 1/1941 | France | 200/331 |
| 1465268 | 2/1969 | Germany | 174/66 |

*Primary Examiner*—Renee S. Luebke
*Attorney, Agent, or Firm*—John P. O'Banion

[57] ABSTRACT

A switch extender for electrical switches having a front plate slidably coupled to a back plate which in turn is attached to a wall-mounted switch plate. The back plate includes a knock-out portion which allows use of the invention with both toggle switches and rocker switches. A pair of cylindrical bars are positioned within an opening in the front plate. A toggle switch fits within a slot between the bars, and the corners of a rocker switch fit within slots outside of the bars on the front plate. Sliding the front plate relative to the back plate actuates the switch.

18 Claims, 5 Drawing Sheets

SWITCH EXTENDER APPARATUS

BACKGROUND OF THE INVENTION

1. Field of the Invention

This invention pertains to switch extender switch actuator devices, and more particularly to a switch extender for wall-mounted electrical switches.

2. Description of the Background Art

Wall-mounted electrical switches are commonly utilized in residential and other building structures to allow persons to activate electric lighting, ceiling fans, air conditioning systems or other electrical appliances. Frequently, wall-mounted electrical switches are structured and configured or are positioned in a manner that makes use of the switches difficult or impossible for children or physically challenged persons.

A variety of switch adapters, extenders and actuators have been developed to facilitate the use of wall mounted electrical switches. For example, devices wherein a pendant handle or actuating member is coupled to and extends downward from a wall switch are well known. Slide actuator devices and covers are also known wherein a sliding member actuates an underlying toggle switch. However, the presently known switch adapter and switch extender art includes some important deficiencies. Particularly, the previously disclosed switch extenders, adapters and actuators have been designed primarily for use with conventional toggle switches. Rocker-type electric switches, which are increasingly used as alternatives to toggle-type electrical switches, are generally not compatible with presently known and available switch extenders, adapters and actuators. A further problem associated with the background art is that many of the currently known devices, particularly those with elongated, pendant handles, are prone to mechanical failure. Many of the known switch extenders and actuators act as levers and, if improperly used, can apply force to the toggle switch in a manner which causes damage to the switch.

Accordingly, there is a need for a switch extender apparatus which may be used with both toggle switches and rocker switches, which is not prone to fatigue and failure due to frequent use, and which does not apply force to wall switches in a manner which can damage the switch. The present invention satisfies these needs, as well as others, and generally overcomes the deficiencies found in the background art.

The foregoing reflects the state of the art of which the applicant is aware and is tendered with the view toward discharging applicant's acknowledged duty of candor in disclosing information which may be pertinent in the examination of this application. It is respectfully stipulated, however, that none of the above information teaches or renders obvious applicant's claimed invention.

SUMMARY OF THE INVENTION

The present invention is a switch extender apparatus for facilitating actuation of wall mounted switches which is compatible with both conventional toggle switches as well as rocker type switches.

In general terms, the invention comprises a back plate having a knock-out portion for accommodating a rocker switch, a front plate which slidably couples to the back plate, and a pair of parallel, spaced-apart cylindrical bars included on the front plate which are positioned to engage and actuate a wall-mounted switch when the front plate is slidably moved relative to the back plate. The invention also comprises means for attaching the back plate to standard wall mounted switch plates.

By way of example and not of limitation, the back plate includes first and second longitudinal grooves or slots which are preferably adjacent first and second sides respectively of the back plate. The knock-out portion associated with the back plate is preferably a rectangular piece having a generally central, rectangular opening structured and configured to accommodate a conventional toggle switch. The knock out portion is reversibly coupled to the back plate, and, upon removal from the back plate, provides a rectangular opening in the back plate which is structured and configured to accommodate a conventional rocker switch. First and second longitudinal rails on the front plate include first and second inwardly disposed lips or flanges which slidably engage the first and second grooves on the back plate. A generally rectangular aperture is included on the front plate, with the pair of horizontal bars mounted within the aperture. The means for coupling the back plate to a wall-mounted switch plate preferably comprises a plurality of bores which accommodate a plurality of standard screws.

If the invention is to be used with a toggle switch, the knock-out portion is generally retained within the back plate, while if the invention is to be used with a rocker switch, the knock-out portion is removed to provide a larger opening in the back plate to accommodate the larger rocker switches. The invention is utilized by slidably mounting the back plate onto the front plate by engaging first and second lips on the first plate within first and second grooves respectively on the back plate. The first and second plates are then coupled to the wall-mounted switch plate, preferably by screws, with the toggle switch positioned between the pair of cylindrical bars, or, if the invention is used with a rocker switch, with the corners of the rocker switch positioned outside the cylindrical bars.

An object of the invention is to provide a switch extender apparatus which allows for quick and easy actuation of electrical switches.

Another object of the invention is to provide a switch extender apparatus which facilitates the use of electric switches for children and physically challenged persons.

Another object of the invention is to provide a switch extender apparatus which may be used with both toggle switches and rocker switches.

Another object of the invention is to provide a switch extender apparatus which does not include pans which are subject to fatigue wear and failure.

Another object of the invention is to provide a switch extender apparatus which will not damage the switch to which it is attached.

Further objects of the invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus which is generally shown in FIG. 1 through FIG. 7. It will be appreciated that the apparatus may vary as to configuration and as to details without departing from the basic concepts as disclosed herein.

Figure 2:
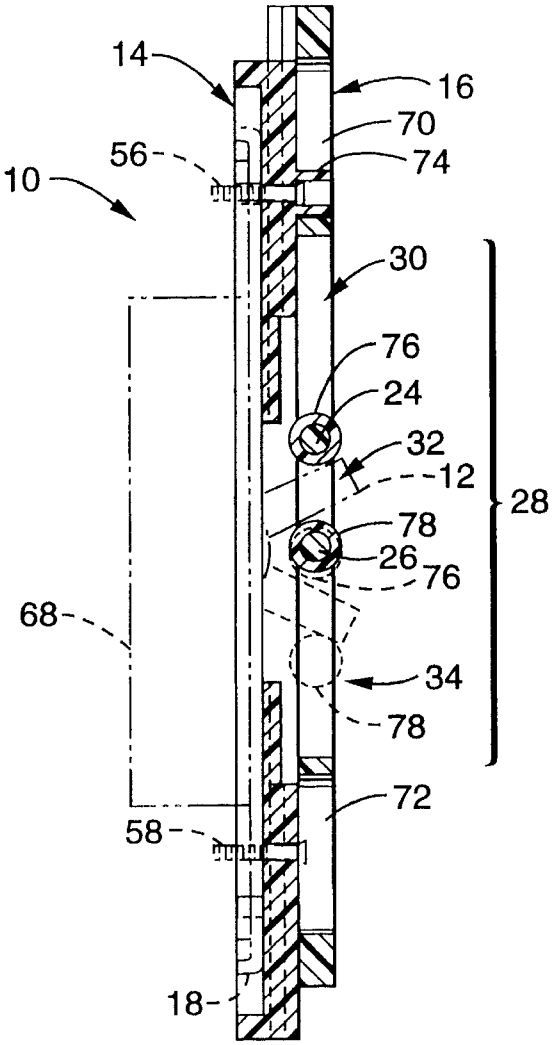
FIG. 2 is a cross-sectional view of the switch extender and toggle switch of FIG. 1 taken through line 2—2.
Figure 1:
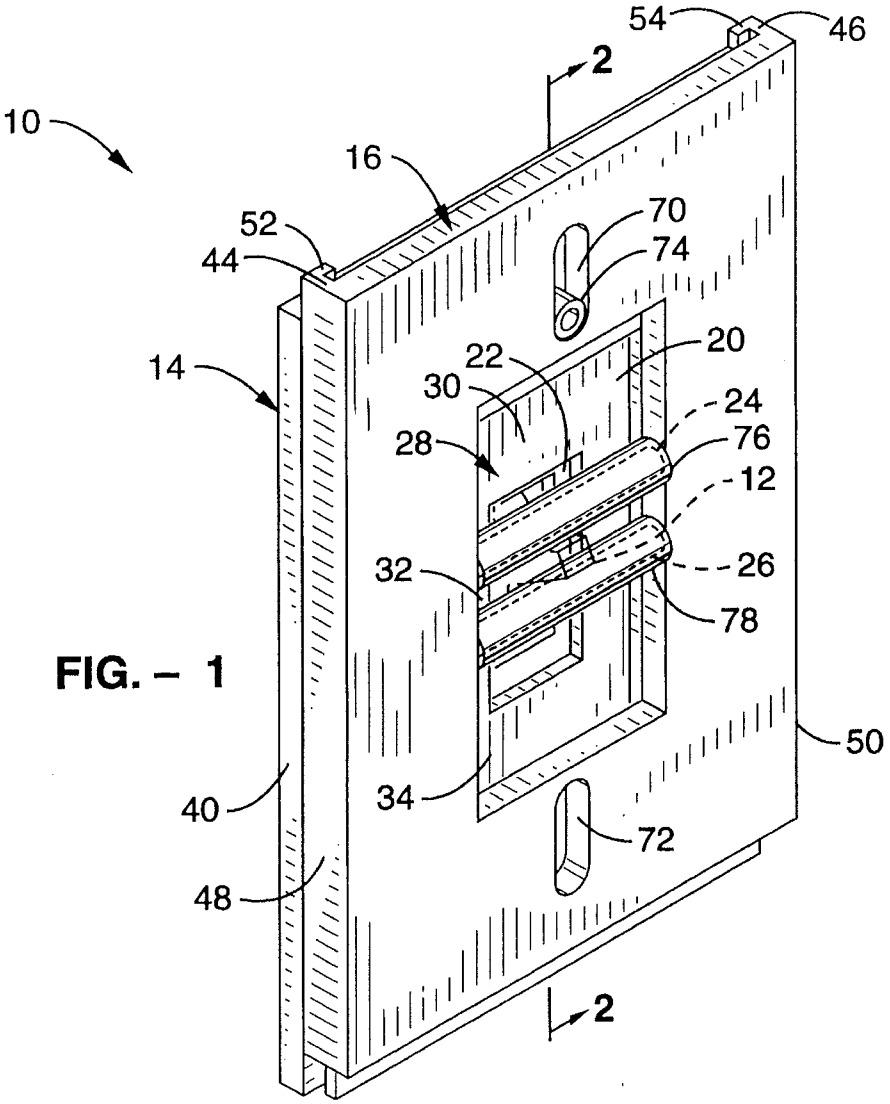
FIG. 1 is a perspective view of the switch extender apparatus of the present invention shown coupled to a conventional toggle switch which is depicted in phantom.
Figure 3:
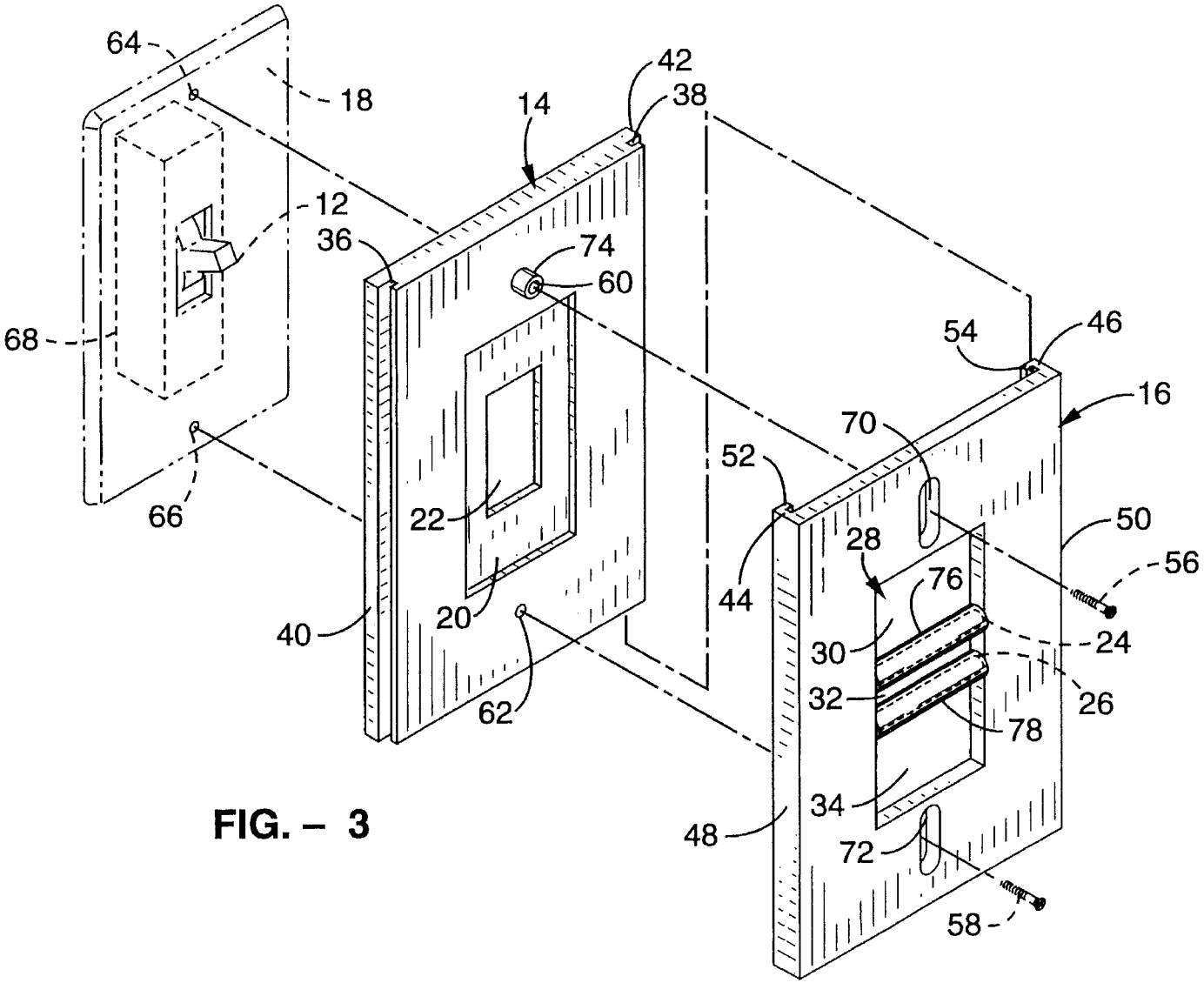
FIG. 3 is an exploded view of the assembly shown in FIG. 1.

Referring first to FIG. 1 through FIG. 3, a switch extender 10 in accordance with the present invention is shown with a conventional wall-mounted toggle switch 12 of the type commonly used for electric light switches. The invention generally comprises a back plate 14 and a front plate 16 which is slidably coupled to back plate 14. A wall-mounted plate 18 is generally included with toggle switch 12, as is standard in the art.

A removable or detachable knock-out portion 20 is included in back plate 14. An opening 22 is included in knock-out portion 20, with opening 22 generally being structured and configured to accommodate toggle switch 12. Removal of knock-out portion 20 from back plate 14 allows the invention to be utilized with a rocker switch, as discussed below.

A pair of substantially cylindrical bars, shown as first bar 24 and second bar 26, are included on front plate 16 and are positioned such that first and second bars 24, 26 are substantially parallel to each other and spaced apart from each other. Preferably, an opening 28 is present on front plate 16, and first and second bars 24, 26 are mounted within opening 28. First and second bars 24, 26 are preferably positioned within opening 28 such that first and second bars 24, 26 define a plurality of slots within opening 28. As shown, a first slot 30 is defined above first bar 24, a second slot 32 is defined between first and second bars 24, 26, and a third slot 34 is defined below second bar 26.

Means for slidably coupling front plate 16 to back plate 14 are included with the invention, and preferably comprise a plurality of longitudinal grooves or channels which are generally parallel to each other and generally spaced apart from each other. As shown in FIG. 3, the plurality of channels preferably includes a first channel 36 and a second channel 38 on back plate 14. Preferably, first channel 36 is generally associated with a first side 40 of back plate 14, and second channel 38 is associated with a second side 42 of back plate 14.

The slidable coupling means also preferably comprises a plurality of longitudinal rails or runners on front plate 16 which are structured and configured to slidably engage the plurality of channels 36, 38 in back plate 14. Generally, the plurality of runners includes a first runner 44 and a second runner 46. First and second runners 44, 46 are associated with a first side 48 and a second side 50 respectively of front plate 16. First and second runners 44, 46 are shown as having an "L" -shaped cross section so that first and second longitudinal lips 52, 54 are provided on first and second runners 44, 46 respectively.

The slidable coupling means as described above may be reversed, so that the plurality of longitudinal channels are included on front plate 16 and the plurality of longitudinal runners are included on back plate 14. Other slidable coupling means are also contemplated for use with the invention. For example, a plurality of protrusions on the front plate 16 or back plate 14 could be provided, which slidably engage a plurality of grooves or channels on the opposing plate. The slidable coupling means may also comprise one or more longitudinal cylinders coupled to the front plate 16 or back plate 14 which slidably engage one or more bores of cylindrical cross section in the opposing plate.

The invention includes means for coupling back plate 14 to the wall-mounted plate 18 associated with toggle switch 12. The coupling means preferably comprises a plurality of bolts or screws 56, 58, which engage bores 60, 62 in back plate 14 and bores 64, 66 in wall-mounted plate 18 in a conventional manner. Screws 56, 58 are preferably the same screws that are used to coupled switch box 68 to wall-mounted plate 18. Elongated apertures 70, 72 are furnished in front plate 16 to provide access to screws 56, 58 while front plate 16 is slidably coupled to back plate 14. A sleeve 74 may be included in association with bore 60 to control the amount of sliding motion of front plate 16 so that front plate 16 does not inadvertently slide off of back plate 14 during use of the invention. Sleeve 74 thus serves as a barrier within elongated aperture 70 which prevents motion of front plate 16 further than allowed by the length of aperture 70.

If desired, back plate 14 may be coupled directly to switch box 68, with wall-mounted plate 18 removed from switch box 68. Alternatively, back plate 14 could be coupled directly to a wall surface rather than to the standard wall-mounted plate 18 associated with conventional switches. In the preferred embodiment, however, it is generally easier and more convenient to attach the back plate 14 of the invention directly to the wall-mounted plate 18 as related above and as illustrated in FIG. 1 through FIG. 3.

The switch extender 10 comprising the invention is utilized generally by slidably engaging first and second lips 52, 54 of first and second runners 44, 46 on front plate 16 into first and second channels 36, 38 on back plate 14, so that front plate 16 and back plate 14 are slidably coupled together. Front plate 16 is then slidably positioned relative to back plate 14 so that second slot 32 between first and second cylindrical bars 24, 26 on front plate 16 is positioned adjacent to opening 22 in knock-out portion 20 of back plate 14. Front plate 16 and back plate 14 are then positioned over toggle switch 12 so that toggle switch 12 fits through opening 22 and second slot 32 between first and second bars 24, 26, as shown in FIG. 1 and FIG. 2. Screws 56, 58 are fastened through bores 60, 62 in back plate 14 into bores 64, 66 in wall-mounted plate 18. Bores 64, 66 and bores 60, 62 generally include internal threading (not shown) for engaging screws 56, 58. Apertures 70, 72 in front plate 16 provide access for a screw driver or other tool for fastening screws 56, 58.

The switch extender 10 is thus coupled to wall-mounted plate 18, with toggle switch 12 extending through opening 22 in the knock-out portion 20 of back plate 14, and through slot 32 between first and second bars 24, 26 on front plate 16. By sliding front plate 16 relative to back plate 14, first and second cylindrical bars 24, 26 apply pressure to and actuate toggle switch 12. Rollers or rotating portions 76, 78 may be included on first and second bars 24, 26 to reduce friction with toggle switch 12 and further facilitate actuation of toggle switch 12. Sleeve 74 within elongated aperture 70 controls the degree or amount of sliding motion of front plate 16 relative to back plate 14 and prevents damage to toggle switch 12.

Figure 5:
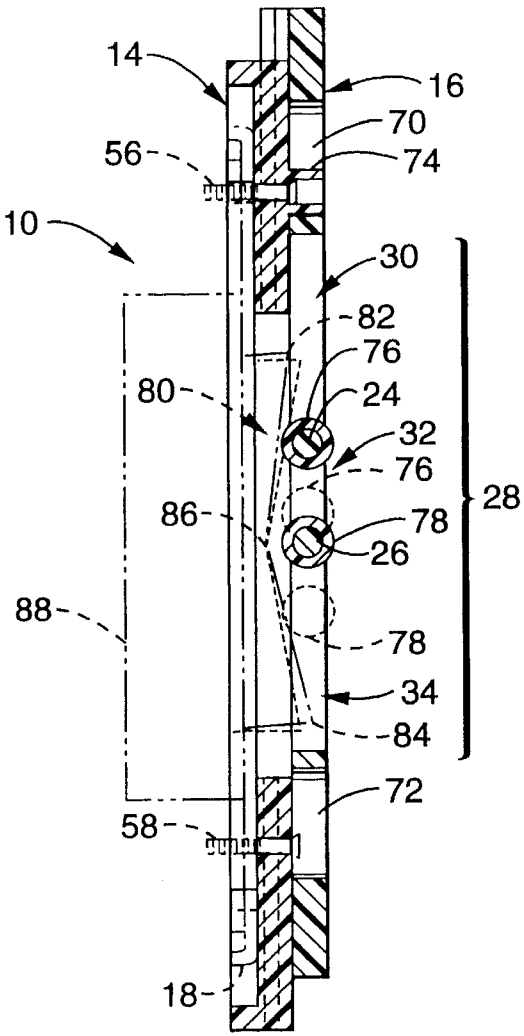
FIG. 5 is a cross-sectional view of the switch extender and rocker switch of FIG. 4 taken through line 5—5.
Figure 4:
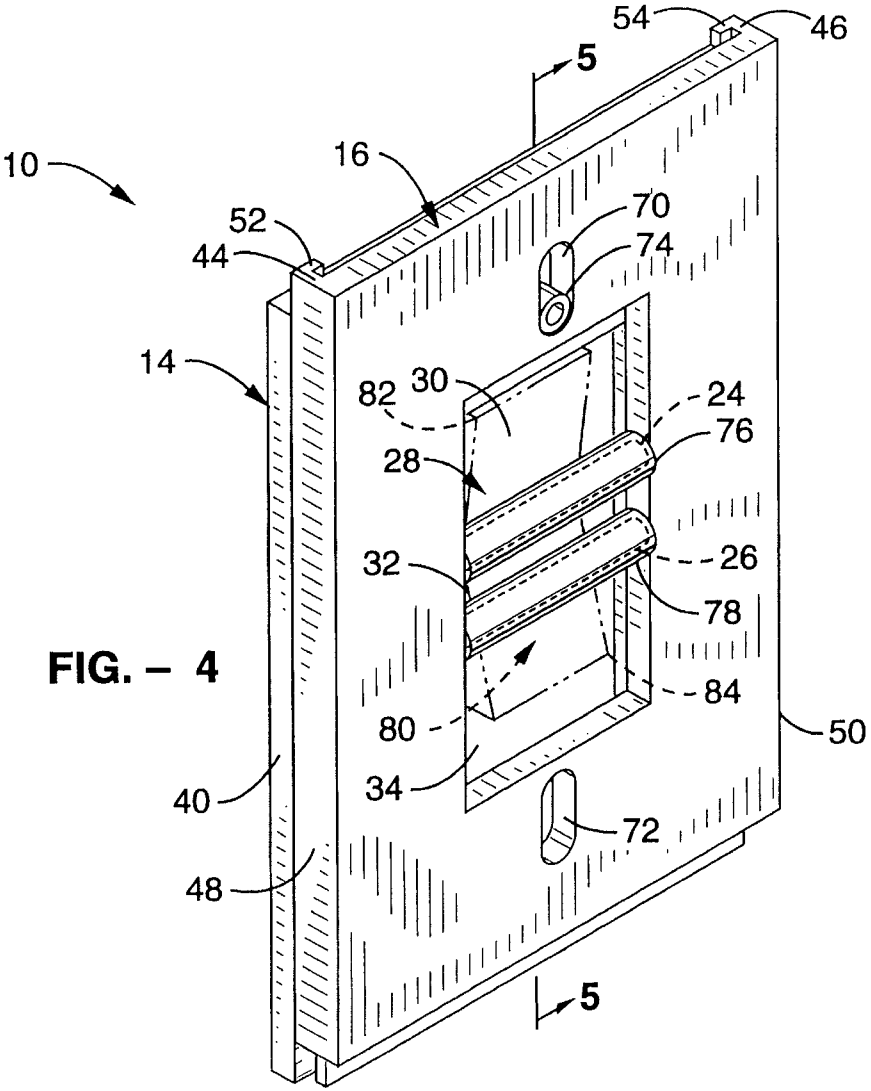
FIG. 4 is a perspective view of the switch extender apparatus of the present invention shown coupled to a conventional rocker switch depicted in phantom.
Figure 6:
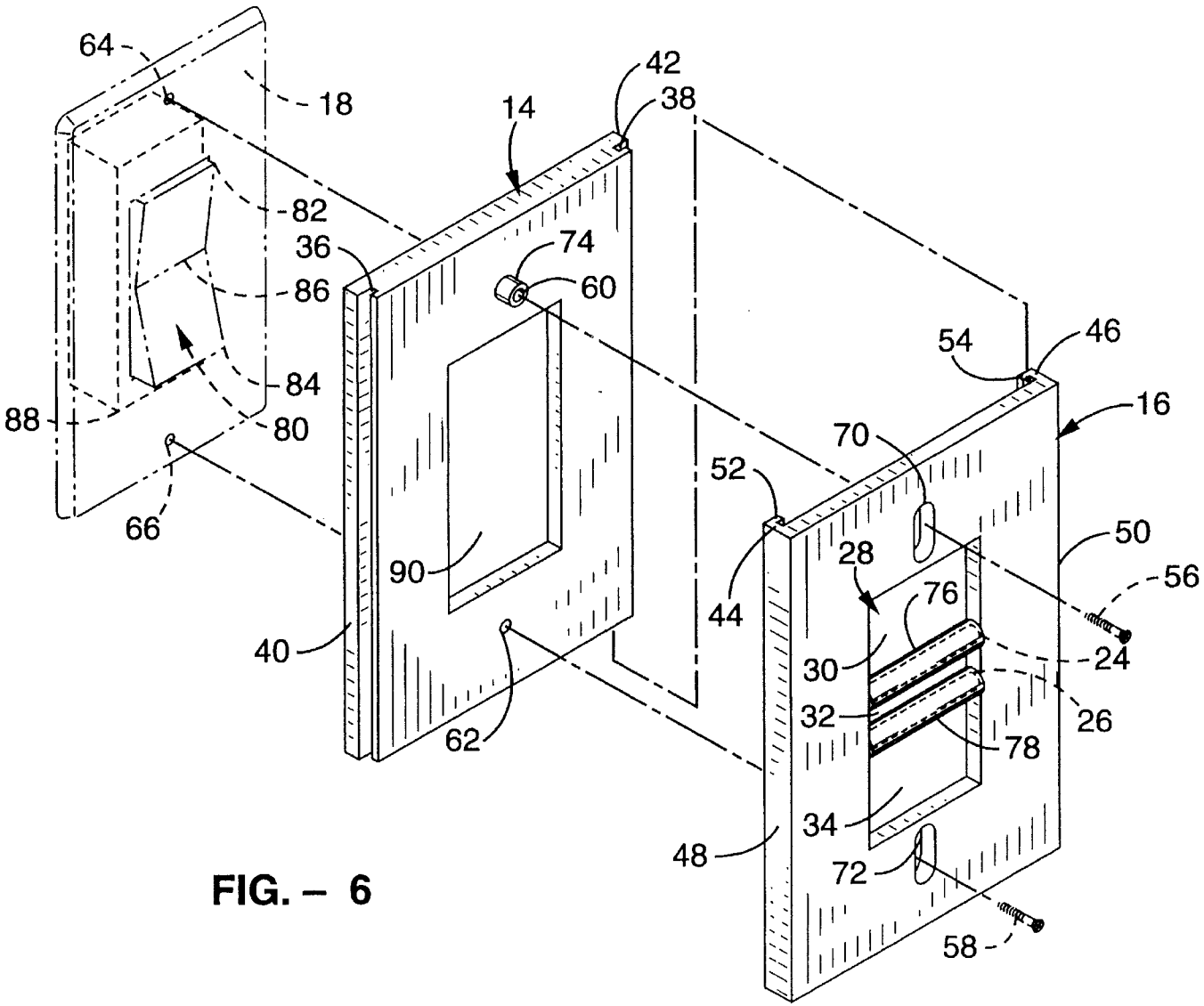
FIG. 6 is an exploded view of the assembly shown in FIG. 5.

Referring now to FIG. 4 through FIG. 6, the invention is shown with a conventional rocker type electrical switch 80. Rocker switch 80 generally includes a first corner or cusp 82 and a second corner or cusp 84 which are separated by a recessed area or fossa 86. Rocker switch 80 also generally includes a rounded rocker section (not shown) contained in switch box 88.

Figure 7:
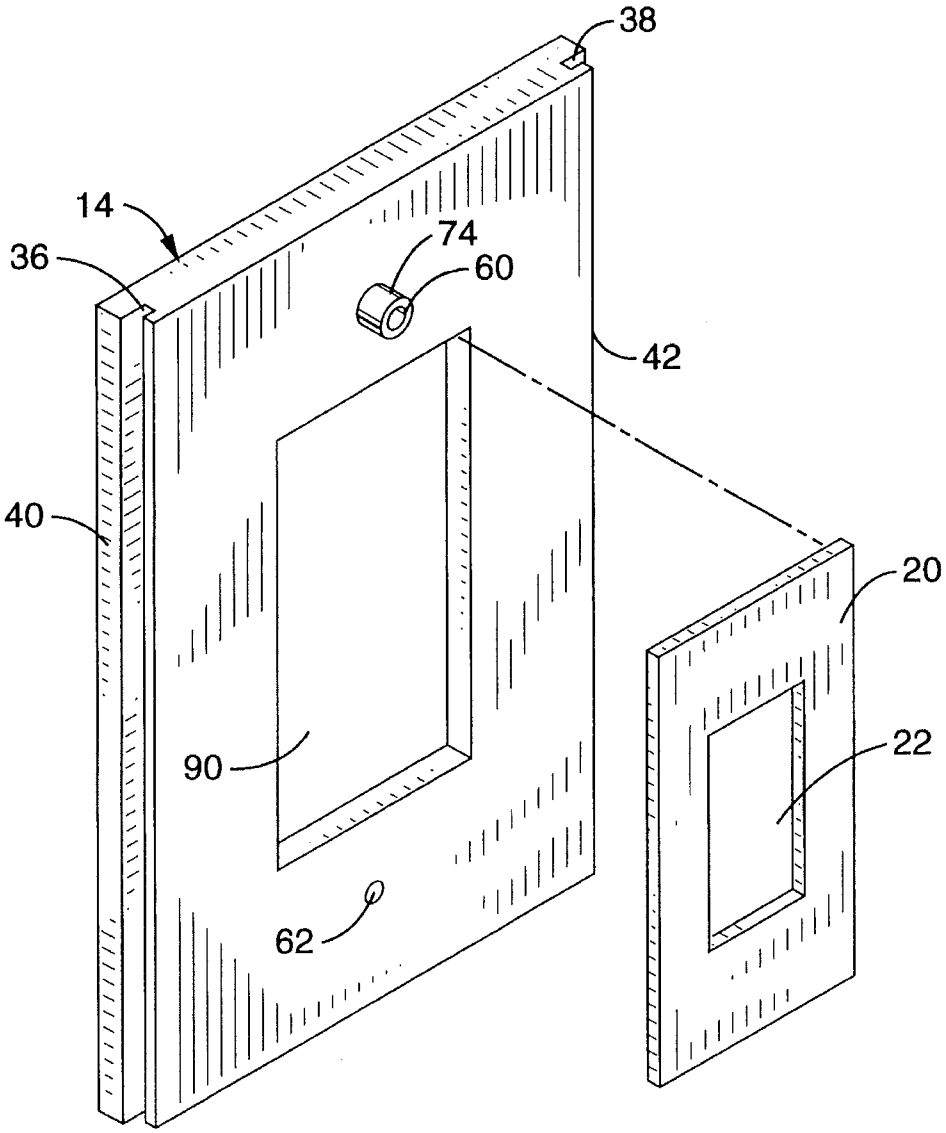
FIG. 7 is a perspective view of the back plate of the invention showing a detached knock-out portion.

The switch extender 10 is utilized with rocker switch 80 by removing knock-out portion 20 from back plate 14, as can be seen by referring in particular to FIG. 7. Removal of knock-out portion 20 from back plate 14 provides an enlarged opening 90 in back plate 14, with opening 90 being generally structured and configured to accommodate conventional rocker switch 80. Knock-out portion 20 is generally held within opening 90 by friction, snap fitting, by frangible portions or bridges (not shown), or by other standard means. If the switch extender 10 is later used with a toggle switch, knock-out portion 20 may be replaced within opening 90 in back plate 14 and affixed therein.

After removal of knock-out portion 20 to provide opening 90, the switch extender 10 comprising the present invention is generally used in a manner similar to that related above for toggle switches. First and second lips 52, 54 of first and second runners 44, 46 on front plate 16 are slidably engaged with first and second channels 36, 38 on back plate 14, so that front plate 16 and back plate 14 are slidably coupled together. Front plate 16 is then slidably positioned relative to back plate 14 so that opening 28 on front plate 16 is positioned adjacent to opening 90 back plate 14. Front plate 16 and back plate 14 are then positioned over rocker switch 80 so that first cusp 82 is received within first slot 30 above first bar 24, and second cusp 84 is received by third slot 34 below second bar 26, with fossa 86 located generally adjacent to second slot 32. Screws 56, 58 are fastened through bores 60, 62 in back plate 14 into bores 64, 66 in wall-mounted plate 18. Sleeve 74 is included in association with bore 60, as related above, to control the degree or amount of sliding motion of front plate 16 relative to back plate 14. Apertures 70, 72 in front plate 16 allow a screw driver or other tool to reach screws 56, 58. By sliding front plate 16 relative to back plate 14, first and second cylindrical bars 24, 26 apply pressure to first and second cusps 82, 84, thereby actuating rocker switch 80. Rollers or rotating portions 76, 78 reduce friction and facilitate switch actuation.

The cylindrical bars 24, 26 and rollers 76, 78 thereon provide for quick and facile actuation of both toggle and rocker type electrical switches by simple sliding of front plate 16 over back plate 14. The invention thus simplifies the switching on and off of electric lights and other appliances. Furthermore, a decorative front plate 16 or decorative cover for front plate 16 may be utilized with the invention. For example, the decoration may include a luminous pattern or character to facilitate location of the switch extender in the dark. And, most notably, to assist younger children who cannot reach a light switch, a character with a downwardly depending appendage can be attached to front plate 16. For example, the character could be an animal such as a monkey or elephant whose tail or trunk hangs down and can be grasped by the child. In this way, the child can easily slide front plate 16 up and down to operate the light switch. Additionally, a recorded message, such as "thank you very much", may be associated with switch extender 10 and activated when switch extender 10 is used, to further encourage children to turn off light switches with the invention.

Since the switch extender 10 contains no elongated pendant parts, the invention is not prone to fatigue and failure as are many background art switch extender and actuator devices. Switch extender 10 is generally structured and configured so that excessive force is not applied to either toggle switches or rocker switches used with the invention, and thus the present invention will not damage the electric switches as can occur with presently available switch extender and switch actuator devices. Further, the components of the invention are preferably fabricated from durable, wear-resistant polymeric materials or polymer composite materials.

The invention is illustrated in FIG. 1 through FIG. 7 in a generally vertical orientation, with front plate 16 sliding vertically relative to back plate 14, since electrical switches are generally installed in wall surfaces in a position such that the switches are actuated in a vertical direction. However, the invention may be installed horizontally with horizontally oriented switches, so that front plate 16 slides horizontally relative to back plate 14.

Accordingly, it will be seen that the present invention provides a switch extender apparatus which allows quick and facile switching of both toggle switches and rocker switches, which is not prone to fatigue and failure, and which does not damage the switches to which it is attached. Although the description above contains many specificities, these should not be construed as limiting the scope of the invention but as merely providing illustrations of some of the presently preferred embodiments of this invention. Thus, the scope of the invention should be determined by the appended claims and their legal equivalents.

What is claimed is:

1. A switch extender apparatus, comprising:

(a) a back plate, said back plate including an opening;

(b) a front plate, said front plate slidably mounted on said back plate;

(c) a pair of cylindrical, parallel, spaced apart bars, said bars included on said front plate; and (d) a knock out portion, said knock-out portion included on said back plate, said opening in said back plate located in said knock-out portion.

2. A switch extender apparatus as recited in claim 1, further comprising means for coupling said back plate to a wall-mounted switch plate.

3. A switch extender apparatus as recited in claim 1, wherein said back plate includes a plurality of channels, said channels parallel to each other.

4. A switch extender apparatus as recited in claim 3, wherein said front plate includes a plurality of runners, said runners parallel to each other, said runners structured and configured to slidably engage said channels in said back plate.

5. A switch extender apparatus, comprising:

(a) a back plate, said back plate including an opening;

(b) a front plate, said front plate including an opening;

(c) means for slidably coupling said front plate to said back plate; and (d) a pair of cylindrical, parallel, spaced apart bars, said bars included on said front plate, said bars mounted in said opening in said front plate.

6. A switch extender apparatus as recited in claim 5, further comprising a knock-out portion, said knock-out portion included on said back plate, said opening in said back plate located in said knock-out portion.

7. A switch extender apparatus as recited in claim 5, further comprising means for coupling said back plate to a wall-mounted switch plate.

8. A switch extender apparatus as recited in claim 5, wherein said first and second cylindrical bars are positioned in said opening in said front plate to define a first slot, a second slot, and a third slot.

9. A switch extender apparatus as recited in claim 5, wherein said first and second cylindrical bars each include a roller.

10. A switch extender apparatus as recited in claim 5, wherein said slidable coupling meas comprises a plurality of channels in said back plate, said channels spaced apart from each other, said channels parallel to each other.

11. A switch extender apparatus as recited in claim 10, wherein said slidable coupling means further comprises a plurality of runners on said front plate, said runners spaced apart from each other, said runners parallel to each other, said runners structured and configured to slidably engage said channels in said back plate.

12. A switch extender apparatus, comprising:

(a) a back plate, said back plate including a removable knock-out portion, said knock-out portion having an opening;

(b) a front plate, said front plate including an opening;

(c) a first cylindrical bar and a second cylindrical bar, said first and second cylindrical bars parallel to each other, said first and second cylindrical bars spaced apart from each other, said first and second bars included on said from plate, said first and second bars mounted in said opening in said from plate;

(d) means for slidably coupling said front plate to said back plate; and (e) means for coupling said back plate to a wall-mounted switch plate.

13. A switch extender apparatus as recited in claim 12, wherein said first and second cylindrical bars are positioned in said opening in said front plate to define a first slot, a second slot, and a third slot.

14. A switch extender apparatus as recited in claim 12, wherein said first and second cylindrical bars each include a roller.

15. A switch extender apparatus as recited in claim 12, wherein said slidable coupling meas comprises a plurality of channels in said back plate, said channels spaced apart from each other, said channels parallel to each other.

16. A switch extender apparatus as recited in claim 15, wherein said slidable coupling means further comprises a plurality of runners on said front plate, said runners spaced apart from each other, said runners parallel to each other, said runners structured and configured to slidably engage said channels in said back plate.

17. A switch extender apparatus, comprising:

(a) a back plate, said back plate including an opening;

(b) a from plate, said front plate slidably mounted on said back plate; and (c) a pair of cylindrical, parallel, spaced apart bars, said bars included on said front plate, said front plate including an opening, said pair of cylindrical bars mounted in said opening.

18. A switch extender apparatus, comprising:

(a) a back plate, said back plate including an opening;

(b) a front plate, said front plate slidably mounted on said back plate; and (c) a pair of cylindrical, parallel, spaced apart bars, said bars included on said front plate, wherein each of said cylindrical bars includes a roller.

* * * * *